US006719474B2

(12) United States Patent
Petit

(10) Patent No.: US 6,719,474 B2
(45) Date of Patent: Apr. 13, 2004

(54) POWDER DISTRIBUTOR WITH IMPROVED DISTRIBUTION

(75) Inventor: Robert Petit, Savigny-sur-Orge (FR)

(73) Assignee: Lir France, Chevilly-Larue (FR)

( * ) Notice: Subject to any disclaimer, the term of this patent is extended or adjusted under 35 U.S.C. 154(b) by 0 days.

(21) Appl. No.: 10/337,408

(22) Filed: Jan. 7, 2003

(65) Prior Publication Data

US 2003/0138285 A1 Jul. 24, 2003

(30) Foreign Application Priority Data

Jan. 18, 2002 (FR) ..... 02 00649

(51) Int. Cl.[7] ..... A46B 11/64

(52) U.S. Cl. ..... 401/281; 401/280; 401/286; 132/298

(58) Field of Search ..... 401/281, 280, 401/270, 277, 107, 108, 286; 132/298, 283

(56) References Cited

U.S. PATENT DOCUMENTS 1,183,680 A * 5/1916 Sauer, Jr. ..... 401/281
1,355,026 A * 10/1920 Austin ..... 401/117
1,379,758 A * 5/1921 George ..... 401/281
1,690,022 A 10/1928 Langhaus
2,240,876 A * 5/1941 Waterud ..... 401/281
4,626,119 A 12/1986 Ladd, Jr.
4,671,690 A * 6/1987 Ladd et al. ..... 401/123
4,728,211 A 3/1988 Ladd, Jr.

FOREIGN PATENT DOCUMENTS

EP 364667 4/1990

* cited by examiner

*Primary Examiner*—David J. Walczak
(74) *Attorney, Agent, or Firm*—Dennison, Schultz, Dougherty & MacDonald

(57) ABSTRACT

A distributor (1) is provided and includes a brush (9) fixed to a powder reservoir (4) consisting of hair tuft (2) and a tuft holder (3) provided with a first powder supply orifice (3000), the reservoir (4) being closed by a closer (5) provided with a second powder supply orifice (5000) and that can be turned manually with respect to the brush holder (3) so as to align the first and the second orifices.

22 Claims, 9 Drawing Sheets

FIG.9c
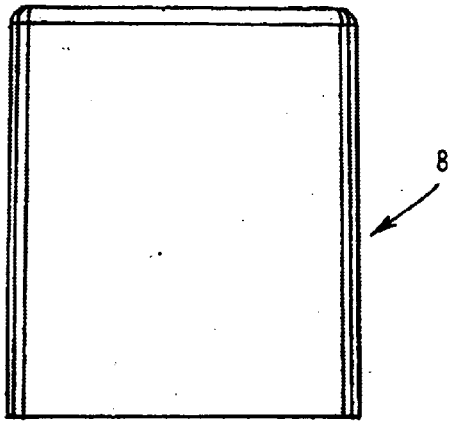
FIG.9d
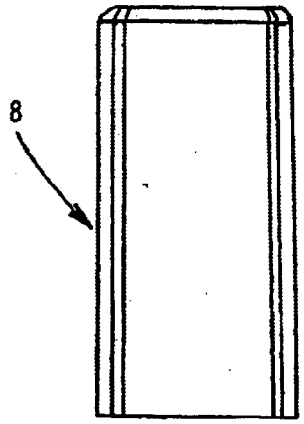
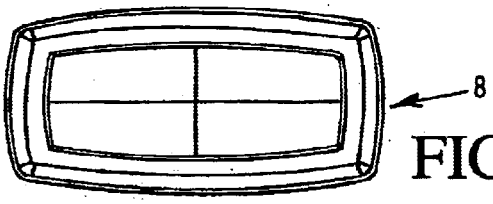
FIG.9b
FIG.9a
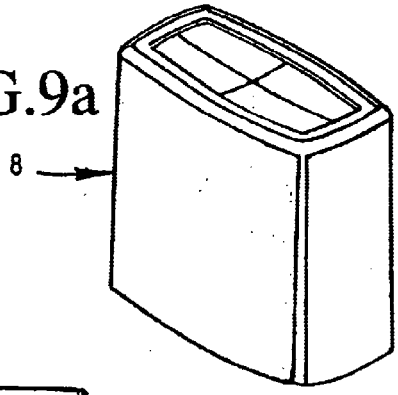
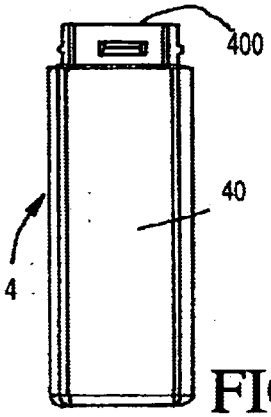
FIG.10d
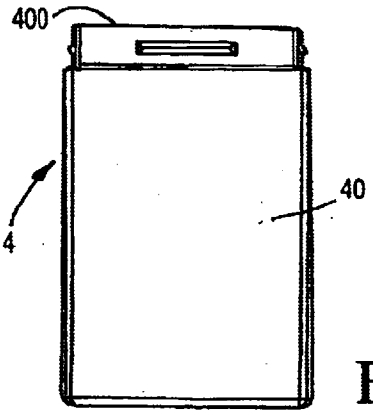
FIG.10c
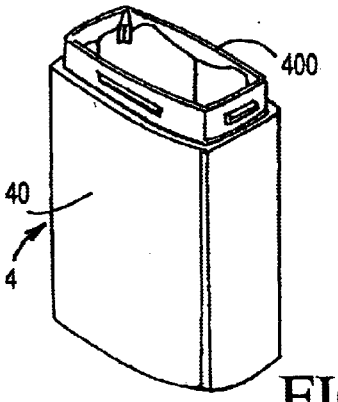
FIG.10a
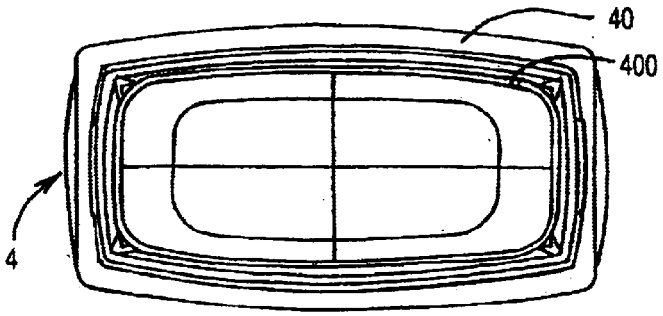
FIG.10b

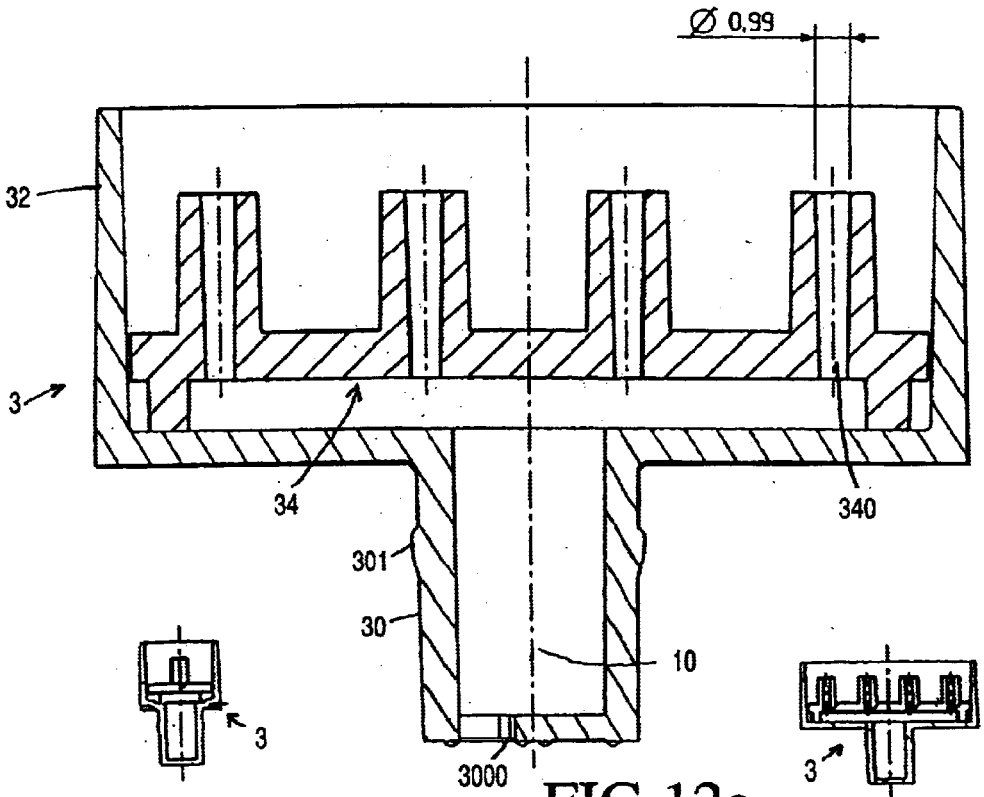
FIG.12a
FIG.12c
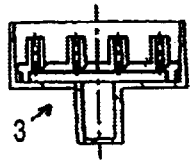
FIG.12b
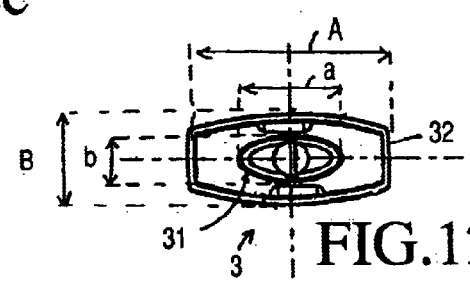
FIG.12f
FIG.12d
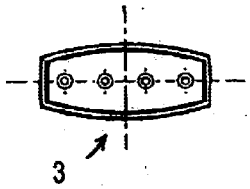
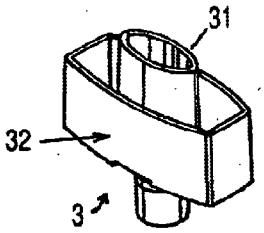
FIG.12h
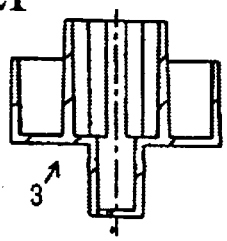
FIG.12g
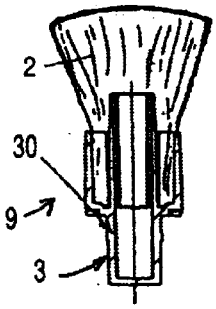
FIG.12e
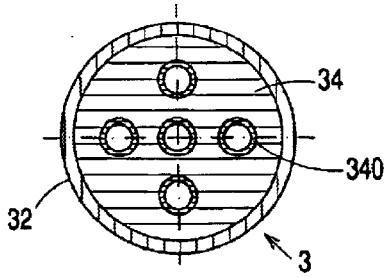
FIG.12i

POWDER DISTRIBUTOR WITH IMPROVED DISTRIBUTION

DOMAIN OF THE INVENTION

This invention relates to powder distributors, and particularly distributors provided with a brush for application of the said powder on a support. In general, the said powder is a cosmetic powder and the said support is facial skin.

STATE OF THE ART

Powder distributors provided with a brush are already known, for example like that described in European patent No. 89111474.6, or that described in American U.S. Pat. No. 4,626,119.

PROBLEMS THAT ARISE

Known distributors have a number of disadvantages. Thus the distributor according to European application No. 89111474.6 comprises a brush fixed to a powder reservoir used as a gripping means, but does not include a brush protection means integrated into the powder reservoir, nor a non-circular distributor and brush.

Similarly, the distributor according to American U.S. Pat. No. 4,626,119 comprises a brush that may contain powder, but it does not comprise a powder reservoir integrated into the brush, nor a non-circular distributor and brush.

Furthermore, none of these distributors solves the problems associated with distribution of powder in the brush, so as to be able to create a shading effect during the first application.

PURPOSE OF THE INVENTION

The purpose of the invention is an arbitrarily shaped powder distributor, typically non-circular, comprising a brush fixed to a powder reservoir that acts as a manual gripping means, the said brush and the said reservoir being in communication with each other while the brush is in use, and comprising a means of protection of the said brush that can be manually activated, activation of this protection means simultaneously cutting off the connection between the said brush and the said reservoir. The distributor also includes a means of distribution of the powder into the hair tuft of the brush.

DESCRIPTION OF THE INVENTION

According to the invention, the powder distributor comprises a brush fixed to a powder reservoir and in communication with the said reservoir, the said reservoir acting as a manual gripping means for the said distributor, in which the said brush comprises a hair tuft and a tuft holder, provided with a first powder supply orifice in which the said reservoir, that can be filled with powder, contains a peripheral skirt, the opening of which is closed off by a closer provided with a second powder supply orifice and in which the said brush is capable of being turned manually with respect to the said closer or reservoir so as to be able to align the said first and second supply orifices and thus enable transfer of powder from the said reservoir to the said brush during use of the said distributor.

This distributor is characterized in that:

a) the said reservoir closer comprises a central duct with a bottom that comprises the said second orifice, b) the said tuft holder comprises a lower tubular part with a bottom that comprises the said first orifice, the said lower tubular part cooperating with the said central duct so as to enable free rotation and possibly an axial connection between the said tuft holder and the said closer, an upper tubular part in communication with the said lower tubular part forming a supply duct through which the said powder is supplied to the said tuft, and a said first skirt fixed to the said lower tubular part or upper tubular part and with a cross section typically similar to the cross section of the said reservoir, the said first skirt being located above the said closer in the axial direction and above the said reservoir in order to enable the said free rotation regardless of the shape of the reservoir, the said tuft being clamped by the said first skirt, c) the said upper tubular part comprises a powder distribution means so as to easily create a shading effect of the said powder during its application, d) the distributor is provided with a guide comprising a second skirt coaxial with the first skirt and that is free to slide along the outside of the first skirt of said tuft holder, typically by a rotation R of the guide so as to achieve an axial displacement D of the guide, and thus to protect or retract the tuft depending on the axial position of the guide with respect to the tuft holder.

Thus, the distributor according to the invention solves all the problems that arise.

The powder distributor according to the invention may be any shape. It comprises a brush fixed to a powder reservoir acting as manual gripping means, the said brush and the said reservoir being in communication during use of the brush. It comprises a guide that can be rotated manually to provide protection for the brush, activation of this means of protection of the tuft consisting of interrupting the communication between the said brush and the said reservoir at the same time.

The distributor also comprises a means of distributing the powder so as to facilitate creation of a shading effect of the said powder during its application.

DESCRIPTION OF THE FIGURES

All figures relate to a distributor or distributor element according to the invention.

FIGS. 1 to 10*d* refer to a first embodiment of the invention. FIGS. 11 to 12*b* relate to other embodiments of the invention.

FIGS. 1 to 4, 5*a*, 6*a*, 7*a*, 8*a*, 9*a*, and 10*a* are perspective views and partially exploded views in the case of figures 1 t0 4.

FIGS. 5*b*, 6*b*, 7*b*, 8*b*, 9*b* and 10*b* are top views.

FIGS. 5*c*, 6*c*, 7*c*, 8*c*, 9*c*, and 10*c* are side views, along the long side.

FIGS. 5*d*, 6*d*, 7*d*, 8*d*, 9*d* and 10*d* are side views, along the short side.

FIGS. 1 and 2 represent the distributor (1) when the guide (6) is not deployed, FIG. 2 being a partial more detailed view of FIG. 1.

FIGS. 3 and 4 show the same distributor (1) when the guide (6) is deployed, FIG. 4 being a partial more detailed view of FIG. 3.

FIGS. 5*a* to 5*d* show the closer (5) of the distributor (1) in FIGS. 1 to 4.

FIGS. 6*a* to 6*d* show the guide holder (7) of the distributor (1) in FIGS. 1 to 4.

FIGS. 7*a* to 7*d* show the tuft holder (3) of the distributor (1) in FIGS. 1 to 4.

FIGS. 8*a* to 8*d* show the guide (6) of the distributor (1) in FIGS. 1 to 4.

FIGS. 9*a* to 9*d* show the removable cap (8) of the distributor (1) in FIGS. 1 to 4.

FIGS. 10*a* to 10*d* show the reservoir (4) of the distributor (1) in FIGS. 1 to 4.

FIGS. 11*a* to 12*i* illustrate other embodiments of the distributor (1) according to the invention.

FIGS. 11*a* to 11*e* illustrate a second embodiment of the distributor (1) with an oblong shape in which the said closer (5) is formed by a central part (56) and a peripheral part (57).

FIG. 11*a* shows an axial section along the vertical axis (10), along the long dimension A of the distributor (1).

FIG. 11*b* shows an axial section along the vertical axis (10), along the short dimension B of the distributor (1).

FIG. 11*c* is a perspective view of the distributor (1).

FIGS. 11*d* and 11*e* are magnifications of FIGS. 11*a* and 11*b* respectively.

FIGS. 12*a* to 12*i* relate to the tuft holder (3) according to the invention.

FIGS. 12*a* to 12*c* relate to a first variant of the tuft holder (3) with an oblong shape that comprises an insert (34) provided with ducts (340) that distribute the powder in the hair tuft (2).

FIG. 12*a* is an enlarged view of an axial section along the axial direct ion D of the distributor (1), FIG. 12*b* corresponding to FIG. 12*a* but at smaller scale.

FIG. 12*c* is drawn at the same scale as FIG. 12*b*, and is an enlarged view along an axial section along the short dimension B of the distributor (1).

FIG. 12*d* is a top view.

FIGS. 12*e* to 12*h* relate to a second variant of the tuft holder (3) with an oblong shape in which the upper tubular part (31) has an oval shape.

FIG. 12*e* is a view similar to FIG. 12*c*, with the tuft holder (3) also comprising a hair tuft (2).

FIG. 12*f* is a top view similar to FIG. 12*d*.

FIG. 12*g* corresponds to FIG. 12*b*.

FIG. 12*h* is a perspective view of the side of the tuft holder (3).

FIG. 12*i* is a top view corresponding to FIGS. 12*d* and 12*f* of a circular tuft holder (3), typically for a distributor with a round cross-section provided with an insert (34) with five ducts (340).

DETAILED DESCRIPTION OF THE INVENTION

Figure 1:
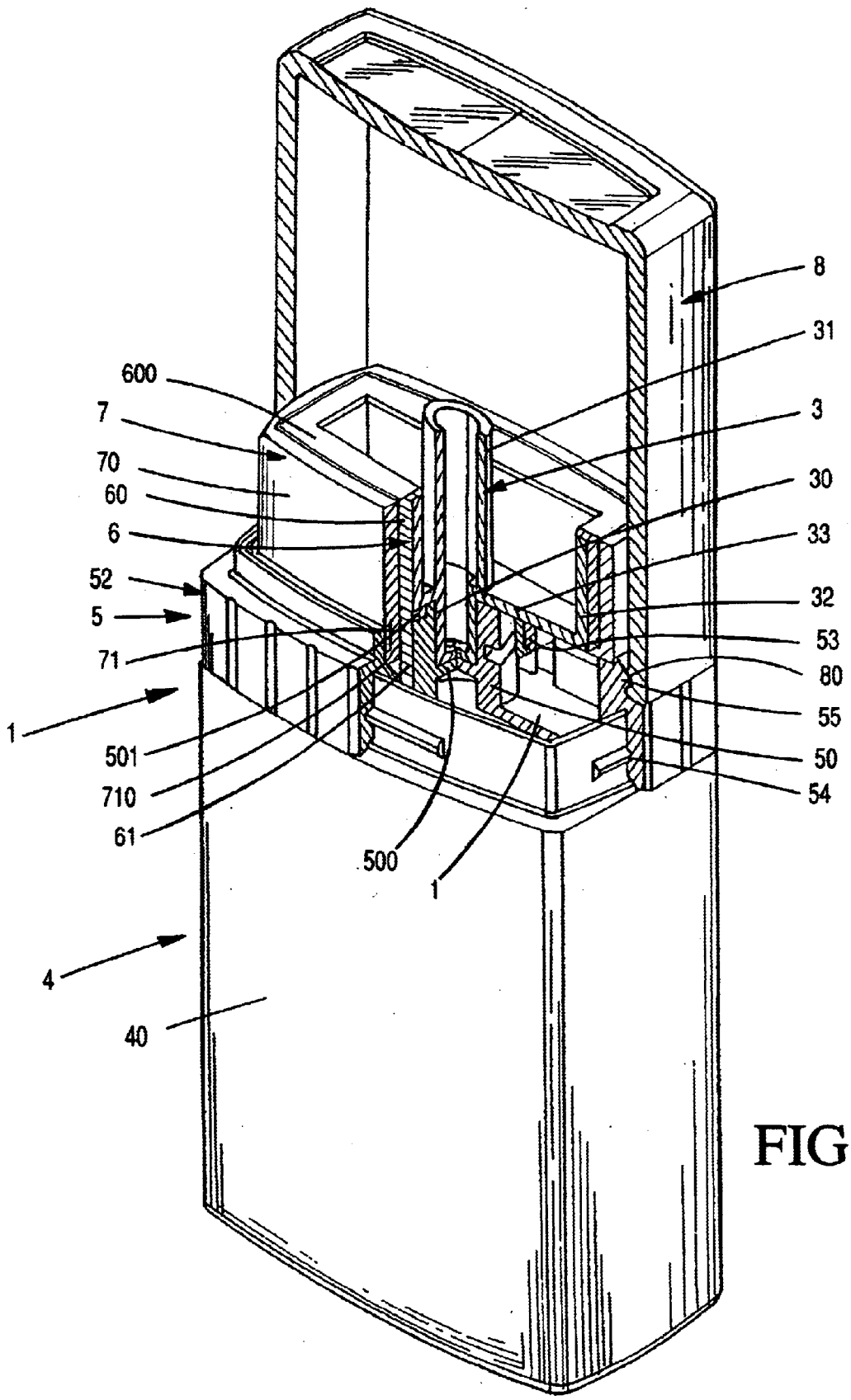
Figure 2:
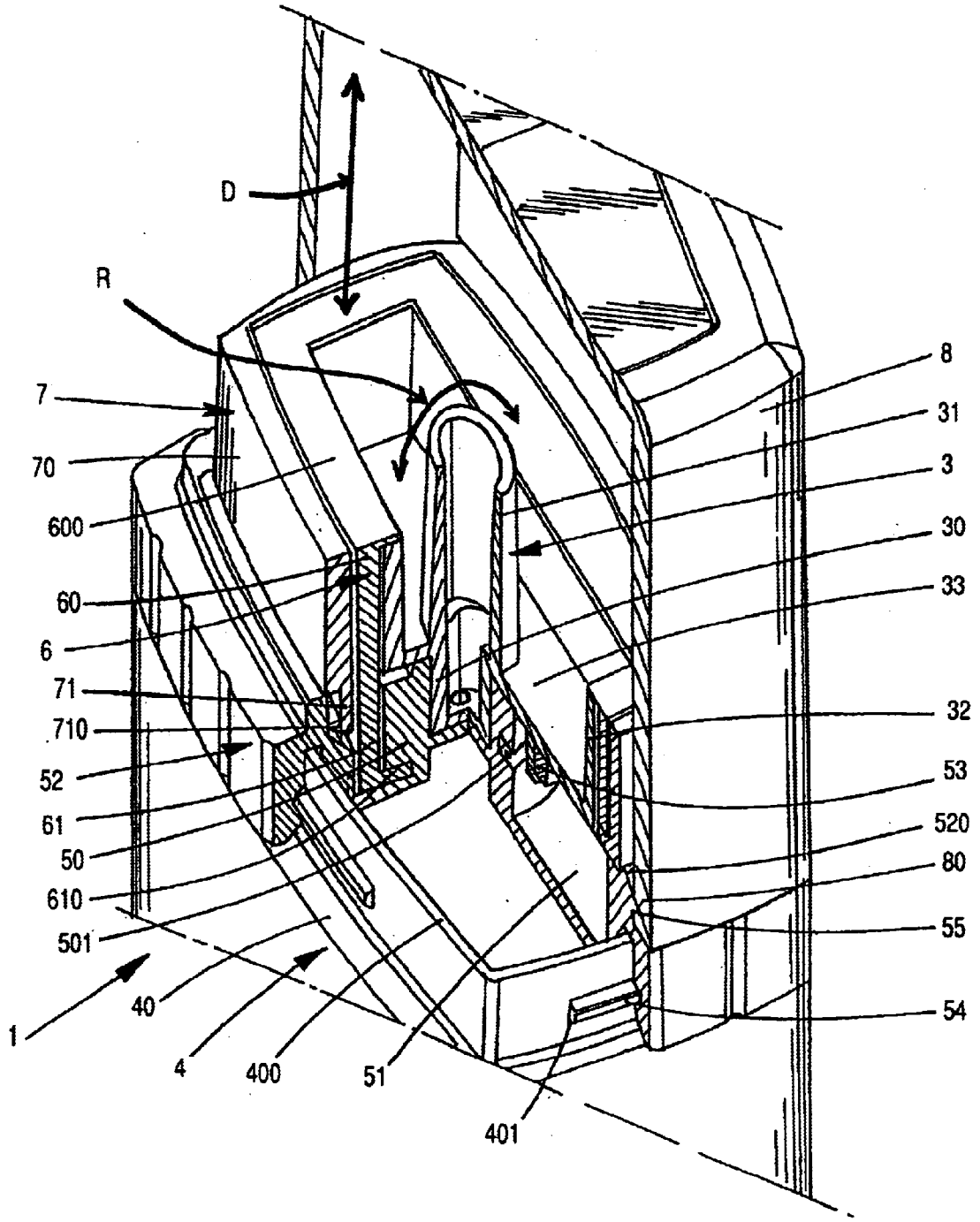
Figure 3:
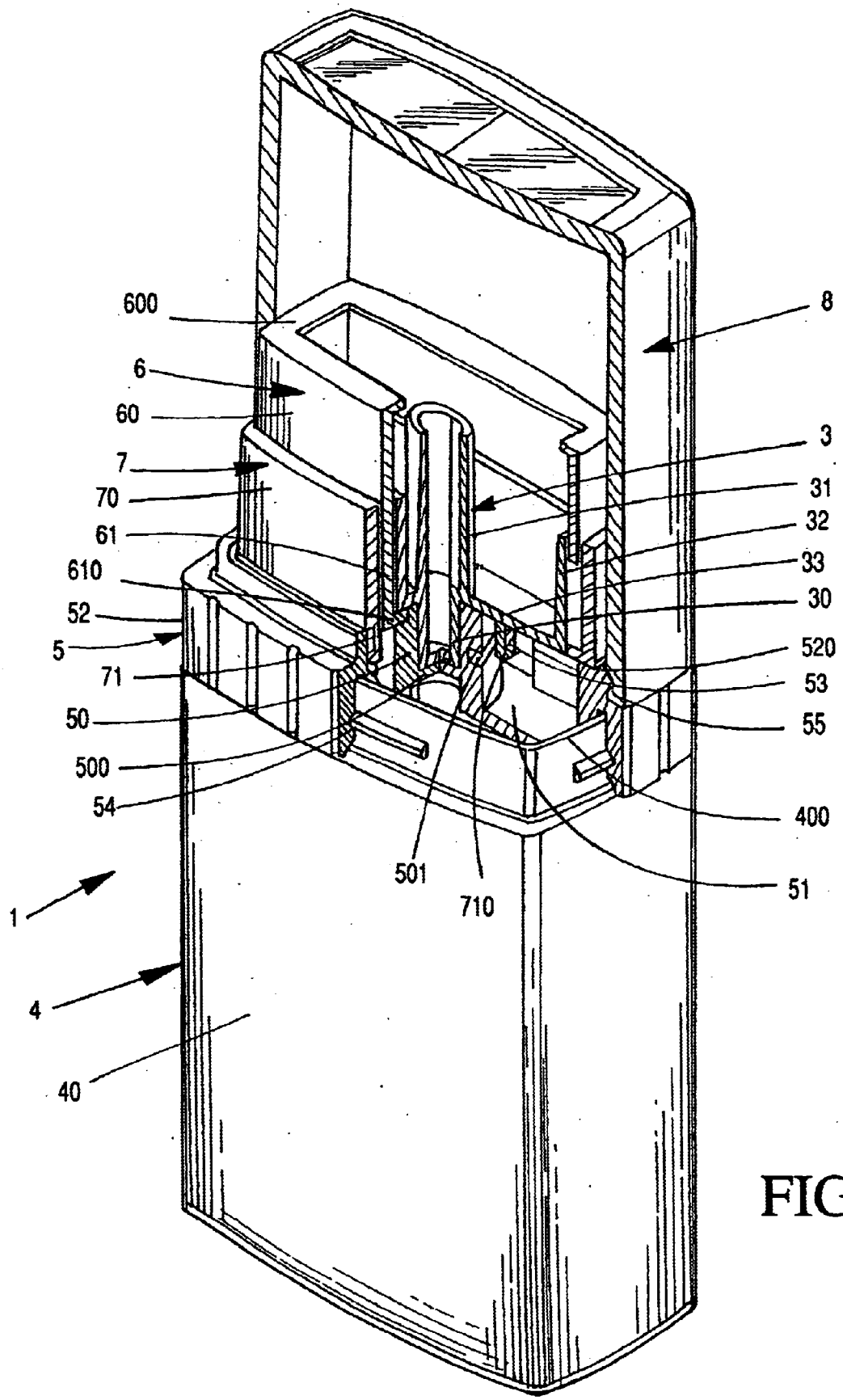
Figure 4:
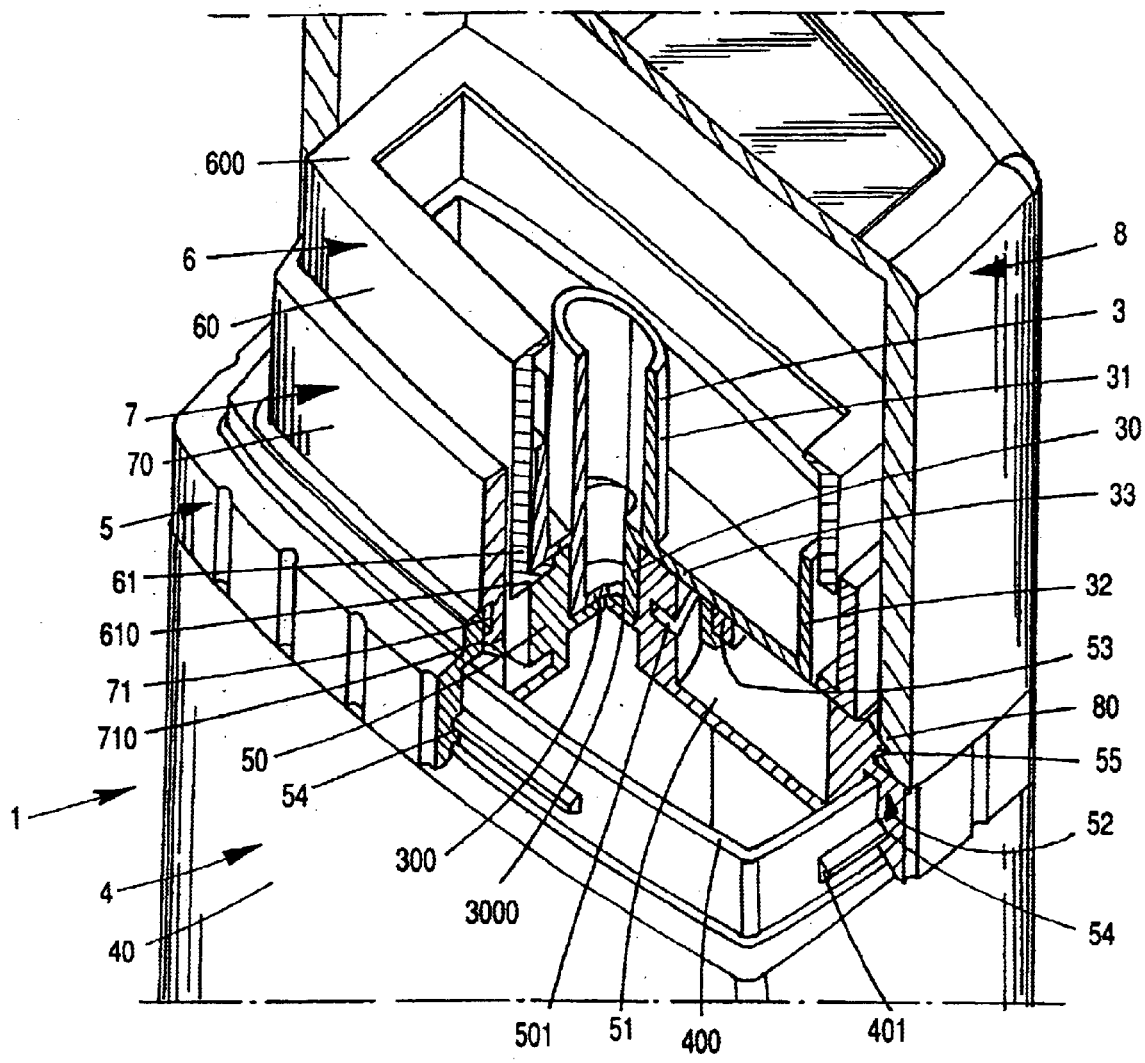

According to one embodiment of the invention, the said guide, comprising the said second skirt coaxial with the said first skirt, is capable of sliding along the outside of the said first skirt of the said tuft holder, by rotation of the said guide.

In this case, the guide may comprise at least one axial displacement tab, the lower end of which supports a radial pin, said central duct being provided with a typically spiral ramp outside its outer surface that cooperates with the pin, such that the rotation R of the guide and the simultaneous rotation of the tuft holder with respect to the closer or the reservoir, displaces the guide along the axial direction D with respect to the brush holder.

In the distributor according to the invention, the said closer (5) may comprise a central panel (51) in the middle of which the said duct (50) is placed, the said duct (50) being at a distance from the said peripheral skirt (40) equal to at least the thickness of the said tab (61), to enable rotation of the said guide (6) with respect to the said closer (5). The said closer (5) may also comprise an outer rim or shoulder (52) so that the said closer can be assembled to the peripheral skirt (40) of the said reservoir (4) at its upper end (400).

The distributors shown in FIGS. 1 to 10*b* comprise a panel (51) that closes off the upper opening of the reservoir (4), but the panel may be larger or smaller depending on the dimensions of this opening, and may even be non-existent in the case of a relatively small opening.

As illustrated in FIGS. 1 to 4 and Sa to 5*d*, the said closer (5) may comprise an outer rim (52) raised above the said central panel (51) and particularly in the shape of an inverted "U" so as to be fixed to the peripheral skirt (40), typically force fitted or click fitting by the cooperation of male and female elements, onto the upper end (400) of the said peripheral skirt (40). This outer inverted "U" rim forms a hoop around this upper end (400).

But the said closer (5) may possibly be fixed, typically force fitted or click fitted, to the inside of the said peripheral skirt (40).

According to another embodiment of the invention illustrated in FIGS. 11*a* to 11*e*, the said closer (5) may be formed of two parts:

- a central part (56) comprising the said central panel (51) free to close off the said reservoir (4),
- a peripheral part (57) comprising the said outer rim and a shoulder (52) to assemble the said peripheral part (57) to the peripheral skirt (40) of the said reservoir (4),
- the said central part (56) and peripheral part (57) possibly cooperating with the said central part inside the said peripheral part, typically by click fitting.

Typically, the second skirt (60) may be between 1 and 5 cm high, depending on the height of the said tuft, typically at least equal to the height of the first skirt (32) such that the tuft can be sufficiently exposed during the application of the powder on the skin, and also to protect it when the distributor is not in use. The axial displacement D of the guide (6) and its skirt (60) is typically approximately equal to the height of this skirt.

As illustrated in FIGS. 1 to 4 and 11*e*, the said second skirt (60) may have an upper rim (600) that covers the upper end (320) of the said first skirt (32), particularly for aesthetic reasons and possibly to prevent axial displacement of the said tuft holder (3).

Figure 11A:
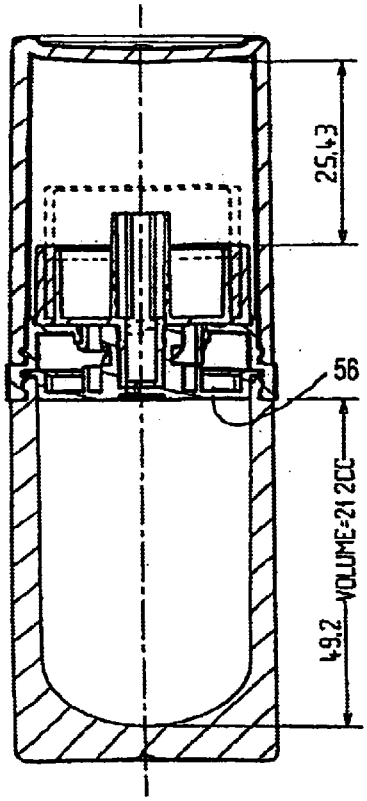
Figure 11B:
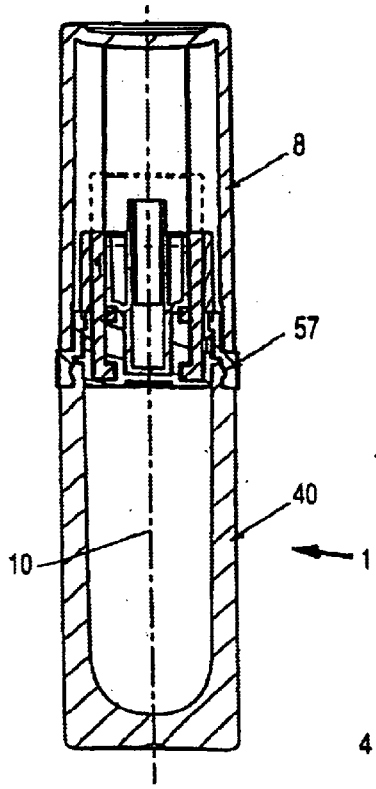
Figure 11C:
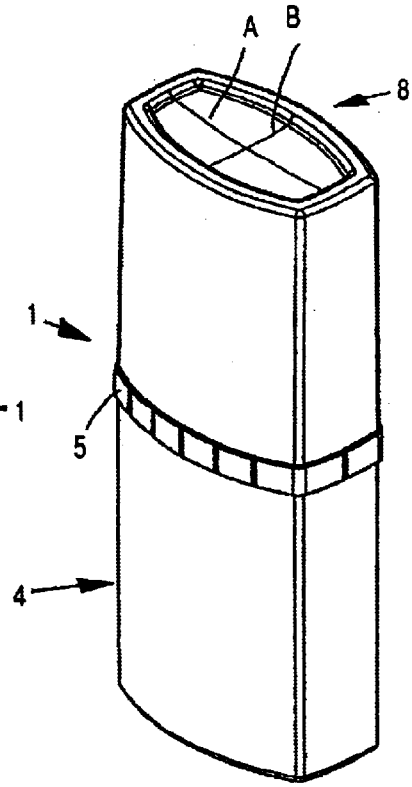
Figure 11D:
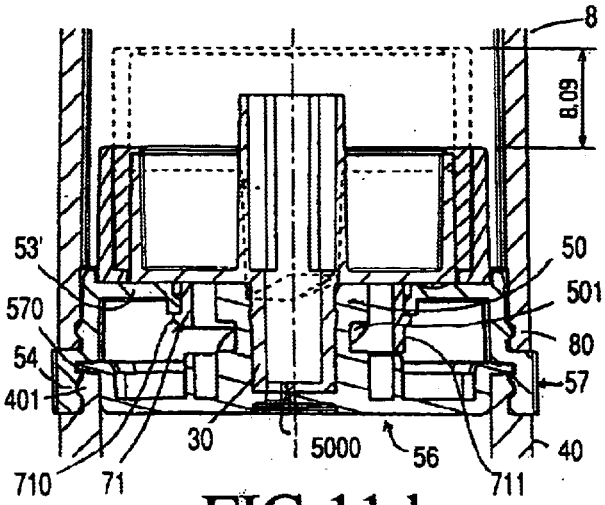
Figure 11E:
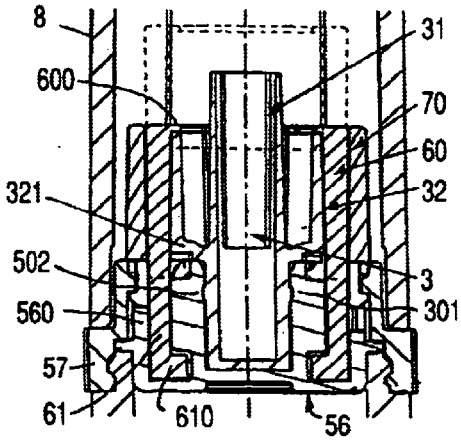

According to the invention and as shown in FIG. 11*e*, the said tuft holder (3) may cooperate with the said closer (5) in order to achieve axial fixity and free rotation between the said tuft holder (3) and the said closer (5), and thus to irreversibly block the axial position of the said guide (6) typically by click fitting (301, 302).

Figure 5C:
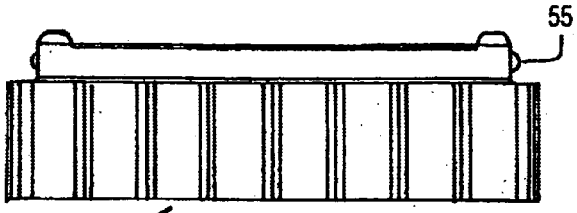
Figure 5D:
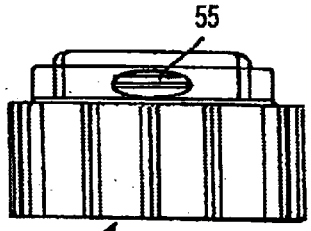
Figure 5B:
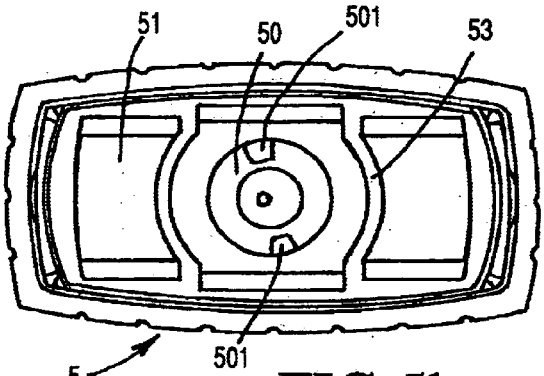
Figure 5A:
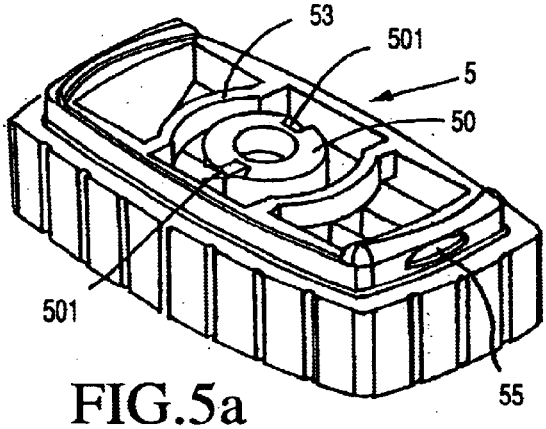
Figure 6C:
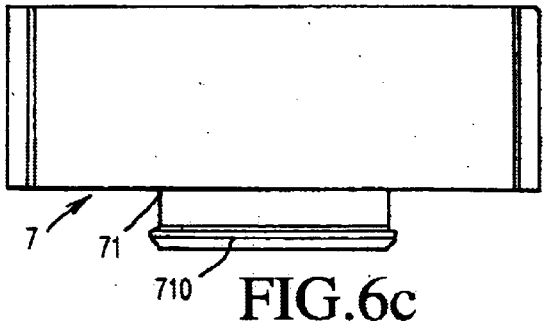
Figure 6D:
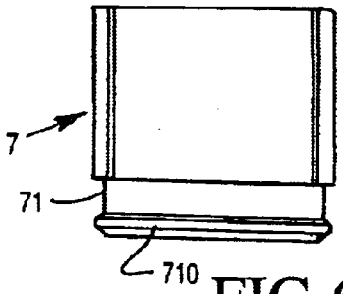
Figure 6B:
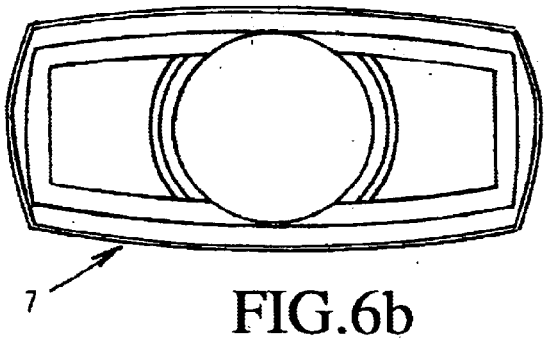
Figure 6A:
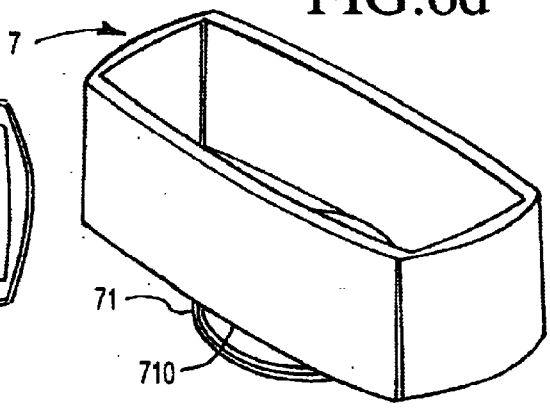
Figure 8D:
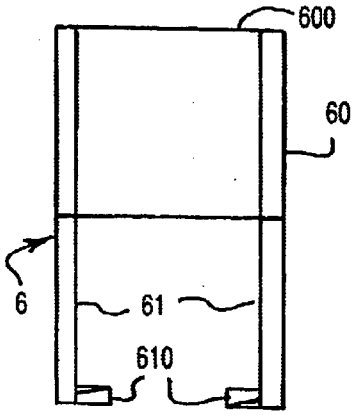
Figure 8C:
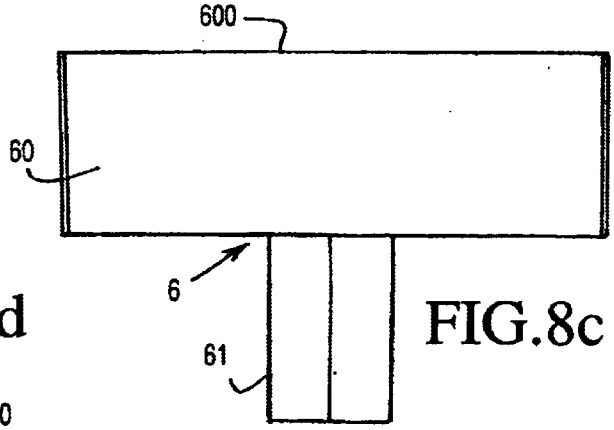
Figure 8A:
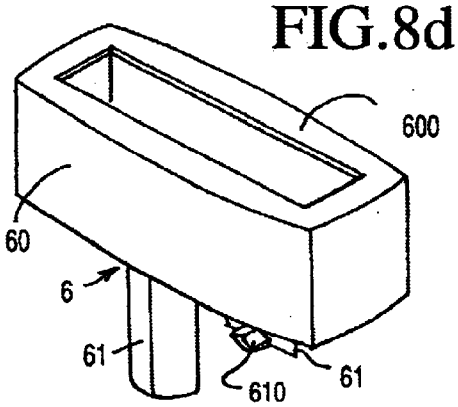
Figure 8B:
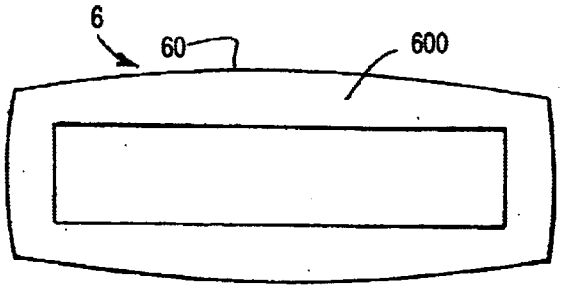

As illustrated in FIGS. 8*a*, 8*d* and 11*e*, the said guide (6) may comprise two axial displacement tabs (61) at 180° from each other, and in this case the said central duct (50) is provided with two spiral ramps (501) at 180° from each other with respect to a vertical axis (10) of the distributor, as shown particularly in FIGS. 5*a*, 5*b* and 11*b*, such that the rotation of the said guide (6) causes axial displacement of it.

According to one embodiment of the invention illustrated in the figures, the said distributor (1) may comprise a guide holder (7) provided with a said third skirt (70) fixed with respect to the said tuft holder (3), the said third skirt (70) being similar to the said first (32) and second (60) skirts, and outside the said second skirt (60) such that the said first (32) and third (70) skirts form two approximately equidistant walls between which the said second skirt (60) of the said guide (6) can be moved axially, the said third skirt (70) being located above the said closer (5) and above the said reservoir (4) in the axial direction, to enable the said simultaneous free rotation of the said first (32), second (60) and third (70) skirts regardless of the shape or the cross-section of the said reservoir (4).

This is a preferred embodiment of the invention, particularly for aesthetic reasons. But technically, the guide holder (7) is not essential to solve the problem of this invention. The guide (6) is positioned radially particularly by the said first skirt (32) of the brush holder (3) and is positioned axially by cooperation between the pins (610) of the tabs (61) and the spiral ramp (501) of the central duct (50) of the closer (5), such that the axial displacement of the guide (6) does not require the presence of the guide holder (7).

As shown particularly in FIGS. 6*a* to 6*d*, and 11*a* to 11*e*, the said guide holder (7) may comprise a lower circular ring (71) comprising a typically irreversible attachment means (710), the said closer (5) or possibly the said peripheral part (57) as illustrated in FIG. 11*d*, the said ring typically rotating the guide holder by 180°.

As can be seen in FIGS. 5*a* and 5*b*, the said closer (5) may comprise contact areas (53) forming arcs coaxial with the said central duct (50) to achieve the said attachment, or a plane panel with a central opening (53') in order to achieve the said attachment, as illustrated in FIGS. 11*a* to 11*e*.

According to the invention, the said distributor may comprise a removable cap (8) that covers the said tuft (2) and is capable of being fixed reversibly, typically by click fitting by cooperation of male (54) and female (80) elements on the said closer (5) or on the upper end (400) of the said peripheral skirt (40).

According to FIGS. 1 to 4, the said cap click fits onto the said closer (5). However, in FIGS. 11*a* to 11*e*, the said cap cooperates with the peripheral part (57) forming a part of the said closer (5), particularly to give a distributor with the same section for the said reservoir (4), the said guide holder (7) and the said cap (8).

As illustrated in FIGS. 1 to 4, 7*b*, 11*d* and 11*e*, the said first skirt (32) may be fixed to the said lower tubular part (30) or upper tubular part (31) due to a typically plane bottom or panel (33) extending between the said lower tubular part (30) or upper tubular part (31) and the said first skirt (32), but with radial contact surfaces or any other variant could perform the same function.

Typically the said bottom or panel (33) may fix the base (321) of the said first skirt (32) to the upper end of the said lower tubular part (30) and/or the lower end of the said upper tubular part (31), and form a support base for the said hair tuft (2).

According to the invention, the said free rotation R of the said tuft holder (3), and of the said guide (6) and possibly the guide holder (7) with respect to the said closer (5) or possibly with respect to the said peripheral part (57), causes axial displacement A of the said guide (6), and may typically extend up to 180° or possibly 360°, the said closer (5) comprising a means of stopping the said rotation R at a predetermined value corresponding to a predetermined axial displacement A.

Thus, as illustrated in FIGS. 1 to 4, the said means may typically include an upper edge (520) forming an over thickness that may or may not be supported locally by the said outer rim (52) so as to provide slight resistance to the said rotation when the said rotation goes outside the said predetermined values.

Similarly, as illustrated in FIGS. 11*d* and 11*e*, the said means may be formed by cooperation between the said lower circular ring (71) and a stop (560) fixed to the said closer (5) or the said central part (56), the said ring (71) comprising a part forming a notch (711) limiting the relative rotation of the said stop (560).

Figure 7C:
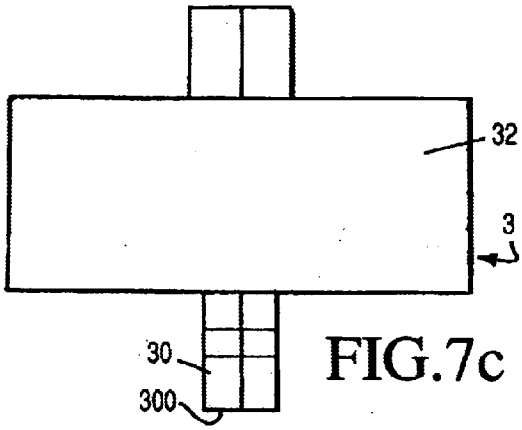
Figure 7D:
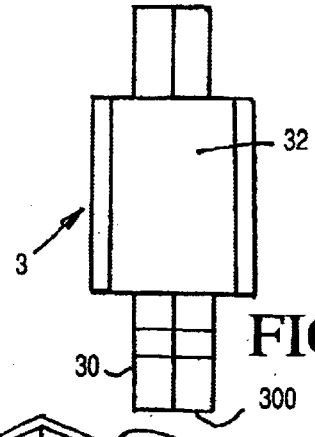
Figure 7B:
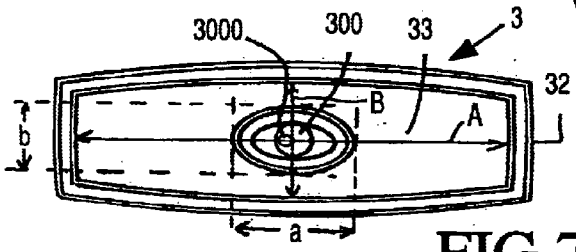
Figure 7A:
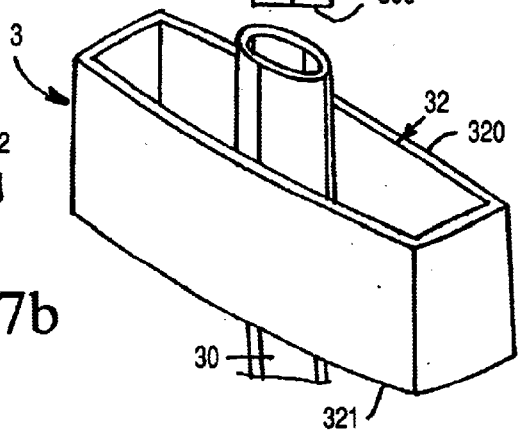

As illustrated in FIGS. 7*b* and 12*f*, the said upper tubular part (31) may comprise at least one end with a typically elliptical cross section with a shape factor a/b similar to the shape factor A/B of the said first skirt (32), where a/b is between 0.6 A/B and 1.4 A/B and is typically greater than 2, so as to form the said distribution means.

According to another embodiment illustrated in FIGS. 12*a* and 12*i*, the said upper tubular part (31) may be an insert (34) typically comprising several ducts (340) in order to distribute the said powder at different locations of the said brush, so as to form the said distribution means.

The distributor according to the invention may be any shape. Typically it may be round as illustrated in FIG. 12*i*, or square or rectangular or oblong as illustrated in FIGS. 1 to 12*h*.

EXAMPLE EMBODIMENTS

Distributors were made according to FIGS. 1 to 10*b*.

This was done using a thermoplastic material to mould a tuft holder (3), a reservoir (4), a closer (5), a guide (6), a guide holder (7) and a cap (8).

Firstly the tuft holder (3), the guide (6) were assembled followed by the guide holder (7). This assembly was click fitted onto the closer (5), which was itself click fitted onto the reservoir (4).

Distributors were also made as shown in FIGS. 11*a* to 11*e*, and 12*a* to 12*i*. In this case, the two parts forming the closer (5) (the central part (56) and the peripheral part (57)) were made, and they were assembled based on the side click fit grooves (570) (see FIG. 11*d*).

The guide holder (7) was then assembled by click fitting to the peripheral part (57) by means of the hook (710) forming the attachment means supported by the lower circular ring (71) of the guide holder (see FIG. 11*d*).

The next step was to put the tuft holder (3) into the guide (6), this assembly being inserted into the guide holder (7), the pins (610) of the two tabs (61) being engaged in the two spiral ramps (501).

The tuft holder (3) was assembled to the central part (56) by simultaneous rotation of the guide holder (7) and the guide (6), irreversibly click fitting the lower tubular part (30) into the central duct (50) by cooperation of the parts with a relief pattern (301) and a recess pattern (502)—see FIG. 11*e*. Thus, the tuft holder is axially fixed to the central part (56) while remaining at least partially free in rotation, so as to close off the upper ring of the spiral ramps (501) and prevent the pins (610) of the guide (6) from coming out of the spiral ramps (501).

These distributors were tested in comparison with distributors according to the state of the art; in distributors according to the state of the art, powder arrives at the centre of the tuft concentrating it and delivering it during application on the face by dragging, instead of being well dispersed so that it can be dabbed directly on the face, as with distributors according to the invention.

ADVANTAGES OF THE INVENTION

Firstly, the invention is capable of releasing the tuft from the brush following a single gesture by the user, by rotating part of the distributor relative to another part of the distributor, and at the same time putting the reservoir into communication with the tuft base. The reservoir can be closed and the brush tuft can be protected with by making the same gesture in reverse.

Furthermore, the invention may be adapted to any shape of distributor.

The invention is also a means of renewing the image of distributors.

Furthermore, the invention can be used to distribute powder on the hair tuft as required, particularly to create a shading effect during the first application.

Finally, the distributor according to the invention is formed by a limited number of parts that can easily be assembled, typically in a single axial click fit movement.

List of Marks

Distributor . . . 1
Vertical axis . . . 10
Hair tuft . . . 2
Tuft holder . . . 3
Lower tubular part . . . 30
Bottom . . . 300
First orifice . . . 3000
Male click fit element . . . 301
Upper tubular part . . . 31
First skirt . . . 32
Upper end . . . 320
Base or lower end . . . 321
Bottom or plane panel . . . 33
Insert . . . 34
Ducts . . . 340
Reservoir . . . 4
Peripheral skirt . . . 40
Upper end . . . 400
Click fit means . . . 401
Closer . . . 5
Central duct . . . 50
Bottom of duct . . . 500
Second orifice . . . 5000
Spiral ramp . . . 501
Female click fit element . . . 502
Central panel . . . 51
Inverse "U" outer rim . . . 52
Upper edge . . . 520
Arc shaped contact surface . . . 53
Panel with circular opening . . . 53'
Female attachment element . . . 54
Male attachment element . . . 55
Central part (50+51) . . . 56
Limit stop . . . 560
Peripheral part . . . 57
Click fitting groove for 56 570
Guide . . . 6
Second skirt . . . 60
Upper rim . . . 600
Vertical groove . . . 601
Axial displacement tab . . . 61
Pin . . . 610
Guide holder . . . 7
Third skirt . . . 70
Lower circular ring . . . 71
Attachment means . . . 710
Notch . . . 711
Cap . . . 8
Female attachment element . . . 80
Brush (2+3) . . . 9

What is claimed is:

1. Powder distributor (1), comprising:

a brush (9) fixed to a powder reservoir (4) and in communication with the said reservoir, said reservoir (4) acting as a manual gripping means for said distributor, in which said brush (9) comprises a hair tuft (2) and a tuft holder (3) provided with a first powder supply orifice (3000) in which said reservoir (4), that can be filled with powder, contains a peripheral skirt (40) and an opening of which is closed off by a closer (5) provided with a second powder supply orifice (5000) and in which brush (9) is capable of being turned manually with respect to the said closer (5) or reservoir (4) so as to transfer of powder from said reservoir to said brush, characterised in that:

a) said closer (5) of the reservoir (4) comprises a central duct (50) with a bottom (510) that comprises said second orifice (5000), b) said tuft holder (3) comprises a lower tubular part (30) with a bottom (300) that comprises said first orifice (3000), said lower tubular part (30) cooperating with said central duct (50) so as to enable free rotation of said tuft holder (3) and said closer (5), an upper tubular part (31) in communication with said lower tubular part (30) forming a supply duct through which said powder is supplied to said tuft, and a first skirt (32) fixed to said lower tubular part (30) or upper tubular part (31) and with a cross section typically similar to the cross section of said reservoir (4), said first skirt (32) being located above said closer (5) in the axial direction and above said reservoir (4) in order to enable said free rotation regardless of the shape of the reservoir (4), the said tuft being clamped by said first skirt (32), c) said upper tubular part (31) comprises a powder distribution means d) said distributor is provided with a guide (6) comprising a said second skirt (60) coaxial with said first skirt (32) and that is free to slide along the outside of said first skirt (32) of said tuft holder (3), typically by a rotation R of said guide so as to achieve an axial displacement D of said guide, and to protect said tuft (2) depending on the axial position of said guide (6) with respect to said tuft holder (3).

2. Distributor according to claim 1, in which said guide (6) comprises at least one axial displacement pin (61), the lower end of which supports a radial tab (610), said central duct (50) supporting a substantially spiral ramp (501) on a surface thereof cooperating with said pin (610) such that said rotation R of said guide (6) and the simultaneous rotation of said brush holder (3) with respect to said closer (5) or said reservoir (4) causes said axial displacement D of said guide (6) with respect to said tuft holder (3).

3. Distributor according to claim 2, in which said guide (6) comprises two axial displacement tabs (61) at 180° from each other, and said central duct (50) carries two spiral ramps (501) at an angular spacing of 180° with from each other about a vertical axis (10) of the distributor, such that rotation of said guide causes an axial displacement of it.

4. Distributor according to claim 1, in which said closer (5) comprises a central panel (51) at the centre of which said central duct (50) is located, said central duct (50) being at a distance from said peripheral skirt (40) equal to at least the thickness of said tab (61), 50 as to enable said rotation of said guide (6) with respect to said closer (5) and an outer rim or a shoulder (52) so that said closer can be assembled with the peripheral skirt (40) of said reservoir (4).

5. Distributor according to claim 4, in which said outer rim (52) is elevated with respect to said central panel (51) and typically in the shape of an inverted "U" so as to fix the said outer rim (52), force fitted or click fitted by cooperation of male and female elements, on the upper end (400) of the said peripheral skirt (40).

6. Distributor according to claim 4, in which said closer (5) is fixed by force fitting or inside the peripheral skirt (40).

7. Distributor according to claim 4, in which the said closer (5) is formed from two parts:

a central part (56) comprising said central panel (51) capable of closing said reservoir (4), a peripheral part (57) comprising said outer rim or a shoulder (52) for assembling said peripheral part (57) to peripheral skirt (40) of said reservoir (4), said central part (56) and peripheral part (57) cooperating together by click fitting of said central part inside said peripheral part.

8. Distributor according to claim 1, in which said second skirt (60) is between 1 and 5 cm high at least the same height as said first skirt (32), said axial displacement AD being close to said height.

9. Distributor according to claim 8, in which said second skirt (60) has an upper rim (600) that forms a cap on the upper end (320) of said first skirt (32), so as to prevent any axial displacement of the said brush holder (3).

10. Distributor according to claim 1, in which said tuft holder (3) cooperates with said closer (5), so as to achieve axial fixity and free rotation between said brush holder (3) and said closer (50) by irreversibly click fitting (301, 502), thus blocking said guide (6) in the axial direction.

11. Distributor according to claim 1, comprising a guide holder (7) provided with a said third skirt (70) fixed with respect to said tuft holder (3), said third skirt (70) having a similar shape to said first skirt (32) and second skirt (60), and outside said second skirt (60), such that said first (32) and third (70) skirts form two approximately equidistant walls between which said second skirt (60) of said guide (6) may be displaced axially, said third skirt (70) thus being located in the axial direction above the said closer (5) and above the said reservoir (4), to enable the said free rotation of the said first (32), second (60) and third (70) skirts regardless of the shape or cross section of said reservoir (4).

12. Distributor according to claim 11, in which said guide holder (7) comprises a lower circular ring (71) comprising a irreversible attachment means (710) to said closer (5) or possibly to said peripheral part (57), said ring typically rotating the guide holder by 180°.

13. Distributor according to claim 12, in which said closer (5) comprises contact surfaces (53) forming arcs coaxial to said central duct (50), or a plane panel with a central opening (53') in order to make said attachment.

14. Distributor according to claim 1, comprising a removable cap (8) covering said tuft (2) and that can be fixed reversibly by click fitting by cooperation between male (54) and female (80) elements on said closer (5) or on upper end (400) of the said peripheral skirt (40).

15. Distributor according to claim 1, in which said first skirt (32) is fixed to said lower tubular part (30) or upper tubular part (31) due to a typically plane bottom or panel (33) extending between said lower tubular part (30) or upper tubular part (31) and said first skirt (32).

16. Distributor according to claim 15, in which said bottom or panel (33) fixes the base (321) of the said first skirt (32) and upper end of said lower tubular part (30) and/or the lower end of said upper tubular part (31).

17. Distributor according to claim 1, in which said free rotation R of said tuft holder (3) of the said guide (6) and possibly of said guide holder (7) with respect to said closer (5) or possibly with respect to said peripheral part (57), rotation R that causes said axial displacement D of the said guide (6), typically extends up to 180°, or possibly 360°, the said closer (5) or possibly the said peripheral part (57) comprising means of stopping the said rotation R at at least predetermined value corresponding to a predetermined axial displacement A.

18. Distributor according to claim 17, in which said means comprises an upper edge (520) forming an over thickness that may or may not be locally supported by said outer rim (52) that provides slight resistance to said rotation when said rotation varies from said predetermined values.

19. Distributor according to claim 17, in which said means is formed by cooperation between said lower circular ring (71) and a limit stop (560) fixed to said closer (5) or said central part (56), the said ring (71) comprising a part forming a notch (711) limiting the relative rotation of said stop (560).

20. Distributor according to claim 1, in which said upper tubular part (31) comprises at least one end with an elliptical section with a shape factor a/b similar to the shape factor A/B of the said first skirt (32), where a/b is typically between 0.6 A/B and 1.4 A/B, so as to form the said distribution means.

21. Distributor according to claim 1, in which the said upper tubular part (31) is an insert (34) comprising several ducts (340) in order to distribute said powder at different locations on the said brush, in order to form the distribution means.

22. Distributor according to claim 1, with a round, square, rectangular or oblong shape.

* * * * *